US005838117A

United States Patent [19]

Nerone

[11] Patent Number: 5,838,117

[45] Date of Patent: Nov. 17, 1998

[54] BALLAST CIRCUIT WITH SYNCHRONIZATION AND PREHEAT FUNCTIONS

[75] Inventor: Louis R. Nerone, Brecksville, Ohio

[73] Assignee: General Electric Company, Schenectady, N.Y.

[21] Appl. No.: 810,495

[22] Filed: Feb. 28, 1997

[51] Int. Cl.[6] ..... H05B 37/02

[52] U.S. Cl. ..... 315/307; 315/201 R; 315/226; 315/225; 315/243; 315/308; 327/589; 363/24; 363/134

[58] Field of Search ..... 315/308, 307, 315/226, 225, 205, 209 R, 243; 327/291, 589; 363/24, 134

[56] References Cited

U.S. PATENT DOCUMENTS

| | | | |
|---|---|---|---|
| 4,463,286 | 7/1984 | Justice | 315/219 |
| 4,546,290 | 10/1985 | Kerekes | 315/209 R |
| 4,588,925 | 5/1986 | Fahnrich et al. | 315/101 |
| 4,647,817 | 3/1987 | Fahnrich et al. | 315/104 |
| 4,677,345 | 6/1987 | Nilssen | 315/209 R |
| 4,692,667 | 9/1987 | Nilssen | 315/209 R |
| 4,937,470 | 6/1990 | Zeller | 323/289 |
| 4,945,278 | 7/1990 | Chern | 315/209 R |
| 5,223,767 | 6/1993 | Kulka | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,387,847 | 2/1995 | Wood | 315/209 R |
| 5,406,177 | 4/1995 | Nerone | 315/307 |
| 5,514,981 | 5/1996 | Tam et al. | 326/80 |

OTHER PUBLICATIONS (Product Note), "Ballast IC Applications Information," International Rectifier Corporation, Oct. 1994, 3 pages.

(Product Note), "Compact Fluorescent Lamp," SGS–Thompson Microelectronics, Oct. 1995, 2 pages.

*Primary Examiner*—Arnold Kinkead

*Attorney, Agent, or Firm*—Charles E. Bruzga

[57] ABSTRACT

Disclosed is a ballast circuit for a gas discharge lamp comprising a resonant load circuit incorporating the gas discharge lamp, a resonant inductance, and a resonant capacitance. A d.c.-to-a.c. converter circuit induces an a.c. current in the load circuit, and comprises first and second converter switches serially connected in the foregoing order between a bus conductor at a d.c. voltage and a reference conductor. The switches are connected together at a common node through which the a.c. load current flows. The switches each have a control node and a reference node, the voltage between such nodes determining the conduction state of the associated switch. The respective control nodes of the switches are interconnected, and the respective reference nodes of the switches are connected together at the common node. A bridge network, connected between first and second nodes, has first and second input nodes on which respective first and second input signals are applied, and first and second output nodes respectively connected to the common and control nodes so as to control the switching state of the switches. An oscillator provides the first and second input signals, and has a timing input. A first resistor and a serially connected feedback winding are coupled to the timing input. The feedback winding is coupled to the resonant inductance so as to increase oscillator frequency when current in the resonant inductance from the common node lags the voltage between the common node and the reference conductor, and to decrease the frequency when the current leads the voltage.

17 Claims, 4 Drawing Sheets

$\phi_1$
TIME $\phi_2$
TIME
$T_4$
$T_1$
$T_2$
$T_3$
$T_4$

BALLAST CIRCUIT WITH SYNCHRONIZATION AND PREHEAT FUNCTIONS

CROSS-REFERENCE TO RELATED APPLICATION

The present invention relates to application Ser. No. 08/709,063, filed Sep. 6, 1996, entitled "Gas Discharge Lamp Ballast Circuit with Complementary Converter Switches." That application is by the same inventor, and is commonly assigned with the present invention.

FIELD OF THE INVENTION

A first aspect of the present invention relates to a ballast circuit for a gas discharge lamp which includes a d.c.-to a.c. converter for supplying a.c. current to a resonant load circuit, and, more particularly, to such a ballast circuit employing a pair of complementary switches in the d.c.-to-a.c. converter. A second aspect of the invention, claimed herein, relates to the foregoing ballast circuit including a feedback function to synchronize the frequency of lamp current to desired starting and operating frequencies, and also including a cathode preheat function.

BACKGROUND OF THE INVENTION

Ballast circuits for gas discharge lamps which include a d.c.-to a.c. converter for supplying a.c. current to a resonant load circuit are known. Typically, such circuits include a pair of non-complementary switches in the d.c.-to-a.c. converter. For example, it is common to use a pair of identical, n-channel enhancement mode MOSFETs as the switches. Each of such non-complementary MOSFETs must be controlled by a separate gate-to-source (or control) voltage. This requires level shifting of voltage to couple a single control signal to each of the gate-to-source voltages of the pair of MOSFETs. Such level shifting can be accomplished by a transformer or by conventional bootstrapping means. The transformer method works well at high speeds, but is costly and hard to control. The bootstrapping method, usually implemented by an Integrated Circuit (IC), has good control capability, but is unable to work at high speeds.

It, would therefore be desirable to provide a ballast circuit for a gas discharge lamp that overcomes the foregoing drawbacks. It would further be desirable for such a ballast circuit to provide a feedback function to synchronize the frequency of lamp current to desired starting and operating frequencies, and also to provide a cathode preheat function.

OBJECTS AND SUMMARY OF THE INVENTION

Accordingly, it is an object of the first aspect of the invention to provide a gas discharge ballast circuit of the type including a pair of switches of a d.c.-to-a.c. converter, which circuit achieves good control capability as well as the ability to work at high speeds.

A further object of the first aspect of the invention is to provide a ballast circuit of the foregoing type that is suitable for integration into an IC.

An object of the second aspect of the invention is to incorporate into a lamp ballast of the foregoing type a feedback function to synchronize the frequency of lamp current to desired starting and operating frequencies.

A further object of the second aspect of the invention is to incorporate a cathode preheat function into a ballast circuit of the first aspect of the invention.

In a preferred form, the invention provides a ballast circuit for a gas discharge lamp comprising a resonant load circuit incorporating the gas discharge lamp, a resonant inductance, and a resonant capacitance. A d.c.-to-a.c. converter circuit induces an a.c. current in the load circuit, and comprises first and second converter switches serially connected in the foregoing order between a bus conductor at a d.c. voltage and a reference conductor. The switches are connected together at a common node through which the a.c. load current flows. The switches each have a control node and a reference node, the voltage between such nodes determining the conduction state of the associated switch. The respective control nodes of the switches are interconnected, and the respective reference nodes of the switches are connected together at the common node. A bridge network, connected between first and second nodes, has first and second input nodes on which respective first and second input signals are applied, and first and second output nodes respectively connected to the common and control nodes so as to control the switching state of the switches. An oscillator provides the first and second input signals, and has a timing input. A first resistor and a serially connected feedback winding are coupled to the timing input. The feedback winding is coupled to the resonant inductance so as to increase oscillator frequency when current in the resonant inductance from the common node lags the voltage between the common node and the reference conductor, and to decrease the frequency when the current leads the voltage.

BRIEF DESCRIPTION OF THE DRAWINGS

The foregoing objects and further advantages and features of the invention will become apparent from the following description when taken in conjunction with the drawing, in which.

DETAILED DESCRIPTION OF THE PREFERRED EMBODIMENTS

Figure 1:
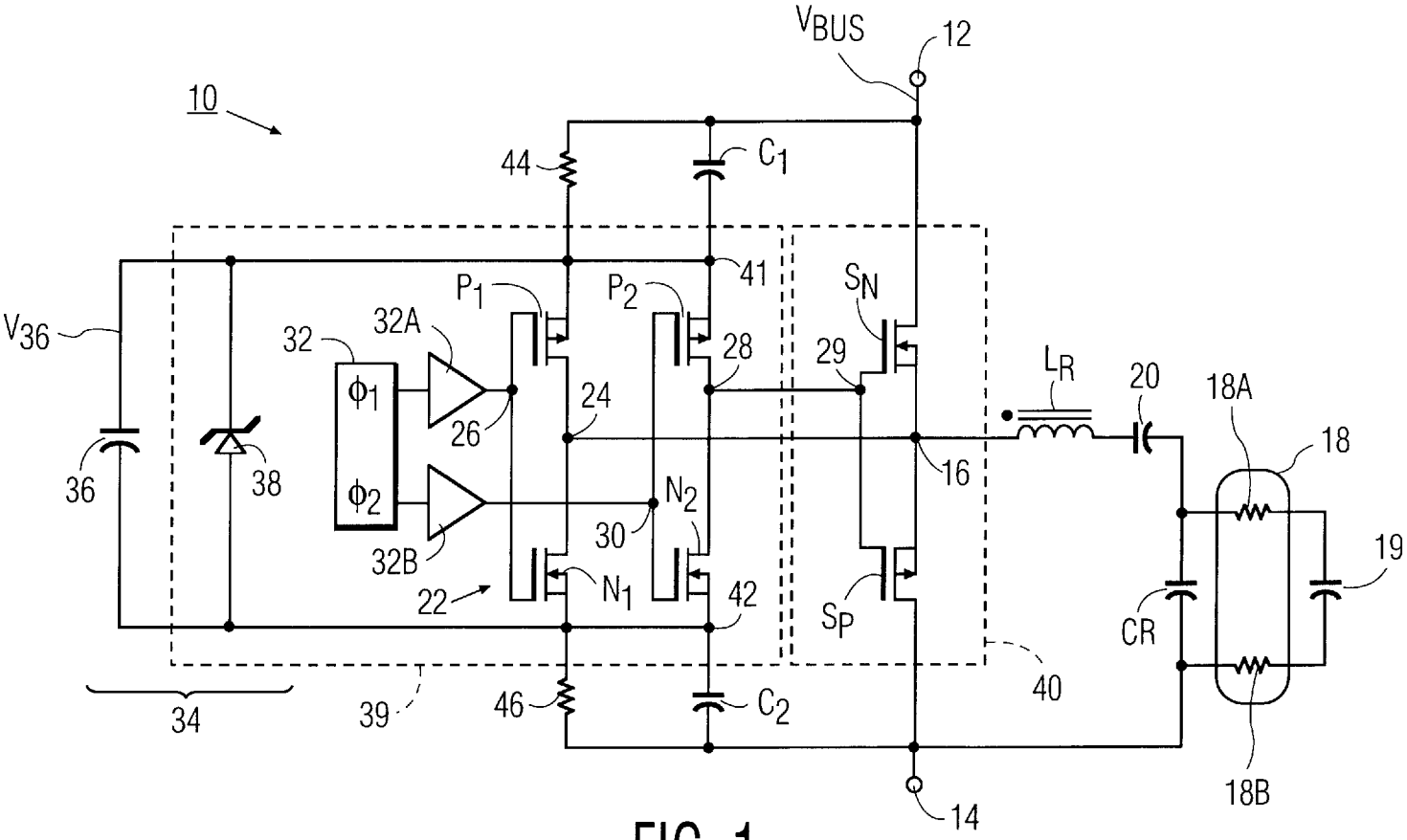
FIG. 1 is a schematic diagram, partially in block form, of a ballast circuit for a gas discharge lamp which employs complementary switches in a d.c.-to-a.c. converter, in accordance with the first aspect of the invention.

FIG. 1 shows a ballast circuit 10 in accordance with the invention. A d.c. bus voltage $V_{BUS}$ is applied to bus conductor 12 with respect to a reference conductor 14. The potential of reference conductor 14 is not necessarily at ground; it simply is a potential less than that of bus conductor 12. As shown, ballast circuit 10 employs a pair of switches $S_N$ and $S_P$ for implementing a d.c.-to-a.c. conversion. Switch $S_N$ may be an n-channel, enhancement mode MOSFET, while switch $S_P$ may be a p-channel, enhancement mode MOSFET. Such switches are, therefore, complementary to each other. The sources of MOSFET switches $S_N$ and $S_P$ are interconnected at common node 16, which node is alternately connected to bus conductor 12 and then to reference conductor 14, and back to bus conductor 12, and so on. Other source-to-source connected MOSFET pairs, or corresponding Bipolar Junction Transistors, could be used if desired.

Converter switches $S_N$ and $S_P$ supply a.c. current to a resonant load circuit comprised of a resonant inductor $L_R$ and a resonant capacitor $C_R$, which capacitor is shunted by lamp 18, such as a fluorescent lamp. Lamp 18 has resistively heated cathodes 18A and 18B, which are preferably shunted by a capacitor 19, whose capacitance thus adds to that of resonant capacitor $C_R$ to produce an overall resonant capacitance. A d.c. blocking capacitor 20 is also provided in the resonant load circuit. Converter switches $S_N$ and $S_P$ are, in turn, controlled by a bridge network 22 preferably formed of drain-connected, complementary conduction mode MOSFETs, which control the gates of the converter switches.

Specifically, bridge network 22 may comprise a first pair of such MOSFETs designated $P_1$ and $N_1$ to represent p-channel and n-channel, enhancement mode MOSFETs, respectively; and a second pair of such MOSFETs designated $P_2$ and $N_2$ for the same reason. As will be appreciated from FIG. 1, each pair $P_1$, $N_1$ and $P_2$, $N_2$ of MOSFETs have respective interconnected drains and interconnected gates. The drains of pair $P_1$, $N_1$ are connected to a first output node 24 of bridge network 22, which is connected to common node 16; the gates of such pair are connected to a first input node 26 of bridge network 22. Similarly, the drains of pair $P_2$, $N_2$ are connected to a second output node 28 of bridge network 22, which is connected to a common control node 29 of the converter switches; the gates of such pair are connected to a second input node 30 of bridge network 22. Preferably, pairs $P_1$, $N_1$ and $P_2$, $N_2$ of bridge network 22 each comprise drain-connected CMOS transistors, which are commonly available.

A first input signal is supplied to first input node 26 by an oscillator 32, via a, e.g., non-inverting buffer 32A; the first input signal is designated by $\phi_1$ in the block for the oscillator. A second input signal is supplied to second input node 30, via a, e.g., non-inverting buffer 32B, the second input signal being designated by $\phi_2$ in the block for the oscillator. The first and second input signals will be described in detail below.

In accordance with an aspect of the invention, an energy source 34 is provided for supplying energy both to power oscillator 32 and to supply, via buffers 32A and 32B, the energy needed to control switch pairs $P_1$, $N_1$ and $P_2$, $N_2$. As will be detailed below, during certain modes of operation of converter switches $S_N$ and $S_P$ residual energy in resonant inductor $L_R$ is used to replenish energy dissipated by source 34 in performing these powering functions. Energy source 34 may comprise a capacitor 36 and a Zener diode 38.

Beneficially, the circuitry inside of dashed-line box 39 described so far can be incorporated into an integrated circuit (IC), and the converter switches themselves, enclosed in dashed-line box 42, can also be incorporated into the same IC in a hybrid or monolithic form.

Each of gate control switch pairs $P_1$, $N_1$ and $P_2$, $N_2$ are connected between a first node 41 at their upper shown-portion, and a second node 42 at their lower-shown portion. A first bootstrap capacitor C1 and a bias resistor 44 are connected between first node 41 and bus conductor 12. A second bootstrap capacitor $C_2$ and a bias resistor 46 are connected between second node 42 and reference conductor 14.

Bootstrap capacitors $C_1$ and $C_2$ preferably perform dual functions. One function is to act as a conventional snubber capacitor for the purpose of causing converter switches $S_N$ and $S_P$ to switch softly, as opposed to abruptly, which considerably reduces energy dissipation in the switches when they change state. The second function of the bootstrap capacitors is a bootstrapping function, wherein residual energy from resonant inductor $L_R$ is used to change the states of charge of the bootstrap capacitors, and in the process to replenish energy of source 34 used in powering oscillator 32 and buffers 32A and 32B. Bootstrap capacitors $C_1$ and $C_2$, therefore, are preferably sized to perform the bootstrap function, which may require a larger size than is required merely to perform the snubbing function. The bootstrap operation of the capacitors is detailed below.

Figures 2A, 2B:
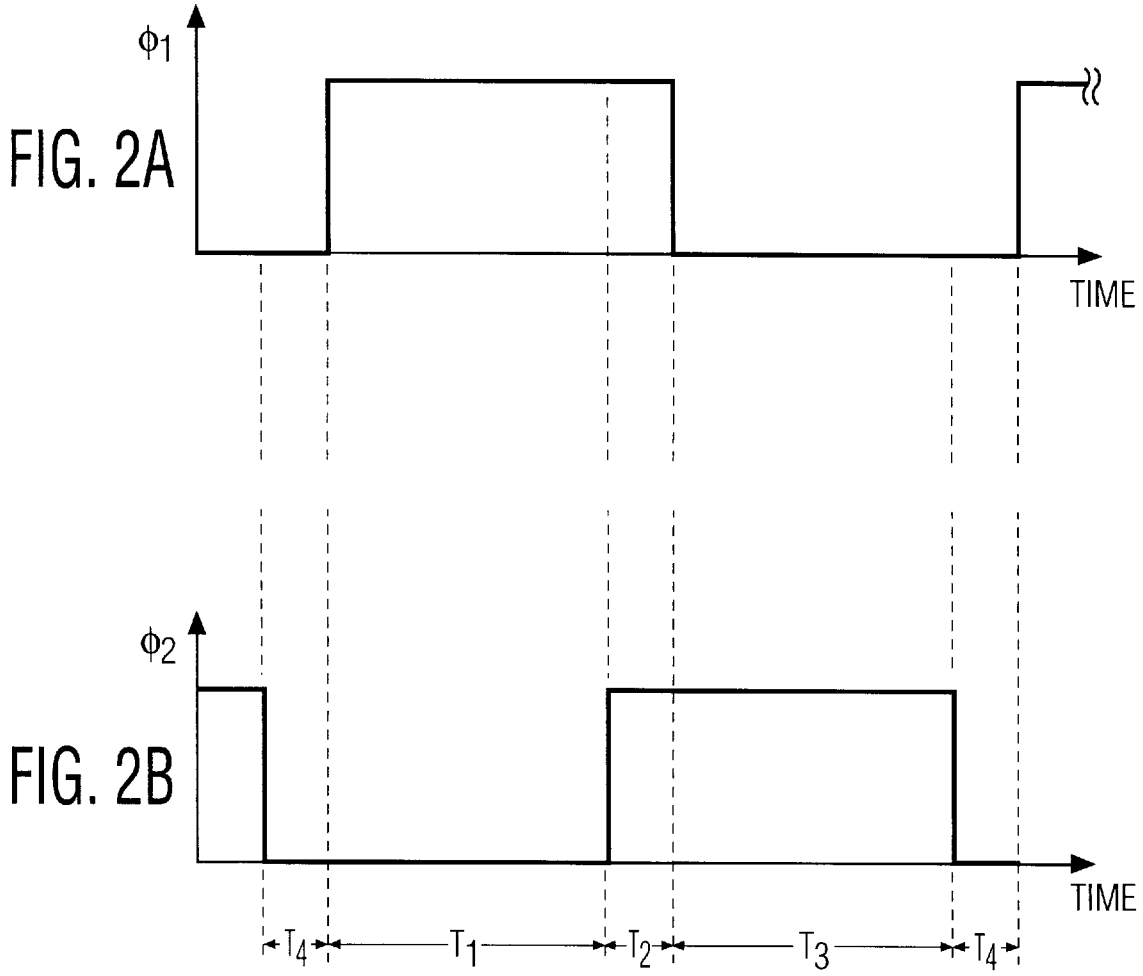
FIGS. 2A and 2B respectively show first and second input signal $\phi_1$ and $\phi_2$ used in the circuit of FIG. 1.

FIGS. 2A and 2B respectively show first and second input signals $\phi_1$ and $\phi_2$ produced by oscillator 32 of FIG. 1. These signals vary between "1" (or high) and "0" (or low), which refer to logic levels, whereby logic level "1" may be 5 volts, for example. In accordance with the invention, oscillator 32 (FIG. 1) provides input signals pairs $\phi_1$,$\phi_2$ that repetitively cycle through at least the four illustrated states of 1-0, 1—1, 0-1 and 0—0. These states respectively occur during time periods $T_1$, $T_2$, $T_3$ and $T_4$. As can be seen in FIG. 2B, after time period $T_4$, time period $T_1$ begins again. One or more other time periods could be interposed among time periods $T_1$ through $T_4$, and represent different input signal pairs $\phi_1$,$\phi_2$, if desired. Operation of ballast circuit 10 of FIG. 1 is now described during each of time periods $T_1$ through $T_4$.

The following table identifies operating states for input signals $\phi_1$ and $\phi_2$, and the conduction states of transistors $P_1$, $N_1$, $P_2$ and $N_2$ of bridge network 22. After the table, the conduction states of converter switches $S_N$ and $S_P$, and the bootstrap operation of capacitors $C_1$ and $C_2$, are described.

| | $\phi_1$ | $\phi_2$ | $P_1$ | $N_1$ | $P_2$ | $N_2$ |
|---|---|---|---|---|---|---|
| $T_1$ | 1 | 0 | OFF | ON | ON | OFF |
| $T_2$ | 1 | 1 | OFF | ON | OFF | ON |
| $T_3$ | 0 | 1 | ON | OFF | OFF | ON |
| $T_4$ | 0 | 0 | ON | OFF | ON | OFF |

During time period $T_1$, converter switch $S_N$ is on (or conducting) and switch $S_P$ is off. During this time, common node 16 is connected to bus conductor 12 so as to be at $V_{BUS}$, which voltage is impressed across bootstrap capacitor $C_2$by virtue of switch $N_1$ being on. Voltages across the capacitors in FIG. 1 are from top-to-bottom. Additionally, bus voltage $V_{BUS}$ is impressed across the serially connected capacitors $C_1$, 36 and $C_2$. With voltage $V_{36}$ being the top-to-bottom voltage across energy source capacitor 36, the foregoing capacitors then respectively have voltages across them of $-V_{36}$ of typically −12 volts for capacitor $C_1$, $V_{36}$ of typically 12 volts for capacitor 36, and $V_{BUS}$ for capacitor $C_2$.

During time period $T_2$, converter switch $S_N$ is turned off, with switch $S_P$ remaining off as it was in time period $T_1$. Residual energy in resonant inductor $L_R$ causes current to flow through such inductor from left to right in FIG. 1, such current passing upwardly through second bootstrap capacitor $C_2$, through switch $N_1$ which is on at this time, and back to resonant inductor $L_R$. Meanwhile, bus voltage $V_{BUS}$ continues to be impressed across the serial combination of capacitors $C_1$, 36 and $C_2$. As a result, the voltage on capacitor $C_2$ changes from $V_{BUS}$ to $-V_{36}$ of typically −12 volts, while the voltage on capacitor $C_1$ changes from $-V_{36}$ of typically −12 volts to $V_{BUS}$. In this process, charge from capacitor $C_2$ is transferred via energy source capacitor 36 to capacitor $C_1$. However, some of the charge from capacitor $C_2$ is retained by capacitor 36, so as to replenish energy used in powering oscillator 32 and buffers 32A and 32B.

In the next time period $T_3$, converter switch $S_N$ remains off and switch $S_P$ is turned on. The voltages across serially connected capacitors $C_1$, 36 and $C_2$ remain as set in the preceding time period $T_2$.

In time period $T_4$, switch $S_N$ remains off and switch $S_P$ is turned off. During this time residual energy in resonant inductor $L_R$ causes current to flow through such inductor from right to left in FIG. 1. With switch $P_1$ being on at this time, such current from resonant inductor $L_R$ flows from node 16 to node 24 and upwardly through switch $P_1$ to pass through bootstrap capacitor $C_1$. Specifically, the voltage of capacitor $C_1$ changes from $V_{BUS}$ as set in time period $T_2$ to $-V_{36}$ of typically −12 volts. Since bus voltage $V_{BUS}$ is impressed across the serial combination of capacitors $C_1$, 36 and $C_2$, the voltage of capacitor $C_2$ changes in from $-V_{36}$ of typically −12 volts set in time period $T_2$, to $V_{BUS}$, while capacitor $V_{36}$ remains at a nearly constant voltage (e.g. 12 volts). In the process of capacitor $C_2$ becoming charged to $V_{BUS}$, charge is transferred from capacitor $C_1$ to capacitor $C_2$. Some charge from capacitor $C_1$ is absorbed by energy source capacitor 36 to replenish energy dissipated in powering oscillator 32 and buffers 32A and 32B.

In the foregoing manner, energy source 34 is supplied with residual energy from resonant inductor $L_R$ during switching periods (e.g., $T_2$, $T_4$) when one converter switch is already off and the other is turned off.

To produce the waveforms shown in FIG. 2 for first and second input signals $\phi_1$ and $\phi_2$, oscillator 32 may comprise a conventional square-wave generator for first input signal $\phi_1$, such as a commonly available 555 IC timer operating in a 50 percent duty ratio mode. To produce second input signal $\phi_2$, a delay circuit from first signal $\phi_1$, such as an R-C (resistive-capacitive) circuit (not shown) can be used to provide a delay, followed by a Schmitt trigger to square up the signal.

Exemplary component values for ballast circuit 10 of FIG. 1 are as follows for a fluorescent lamp 18 rated at 25 watts, with a d.c. bus voltage of 150 volts, and with an operating frequency of about 65 Kilohertz:

| | |
|---|---|
| Resonant inductor $L_R$ | 800 microhenries |
| Resonant capacitor $C_R$ | 4.4 nanofarads |
| Capacitor 19 | 3.3 nanofarads |
| D.c. blocking capacitor 20 | 220 nanofarads |
| Bootstrap capacitors $C_1$ and $C_2$, each | 470 picofarads |
| Bias resistors 44 and 46, each | 100k ohms |
| Zener diode 38 | 12 volts |
| Energy source capacitor 36 | 1 microfarad |

Additionally, converter switch $S_N$ may be an IRF610, n-channel, enhancement mode MOSFET, sold by International Rectifier Company, of El Segundo, Calif.; converter switch $S_P$, an IRF9610, p-channel, enhancement mode MOSFET also sold by International Rectifier Company; gate control switch pairs $P_1$, $N_1$ and $P_2$, $N_2$, each 4000-series pair of drain-connected CMOS transistors, such as sold by Motorola of Phoenix, Ariz., or available as IRF9Z10-IRFZ10 CMOS pairs sold by International Rectifier Company. Finally, exemplary times $T_1$, $T_2$, $T_3$ and $T_4$ used by oscillator 32 are, respectively, 6.5 microseconds, 1.0 microsecond, 6.5 microseconds, and 1.0 microseconds.

Figure 3:
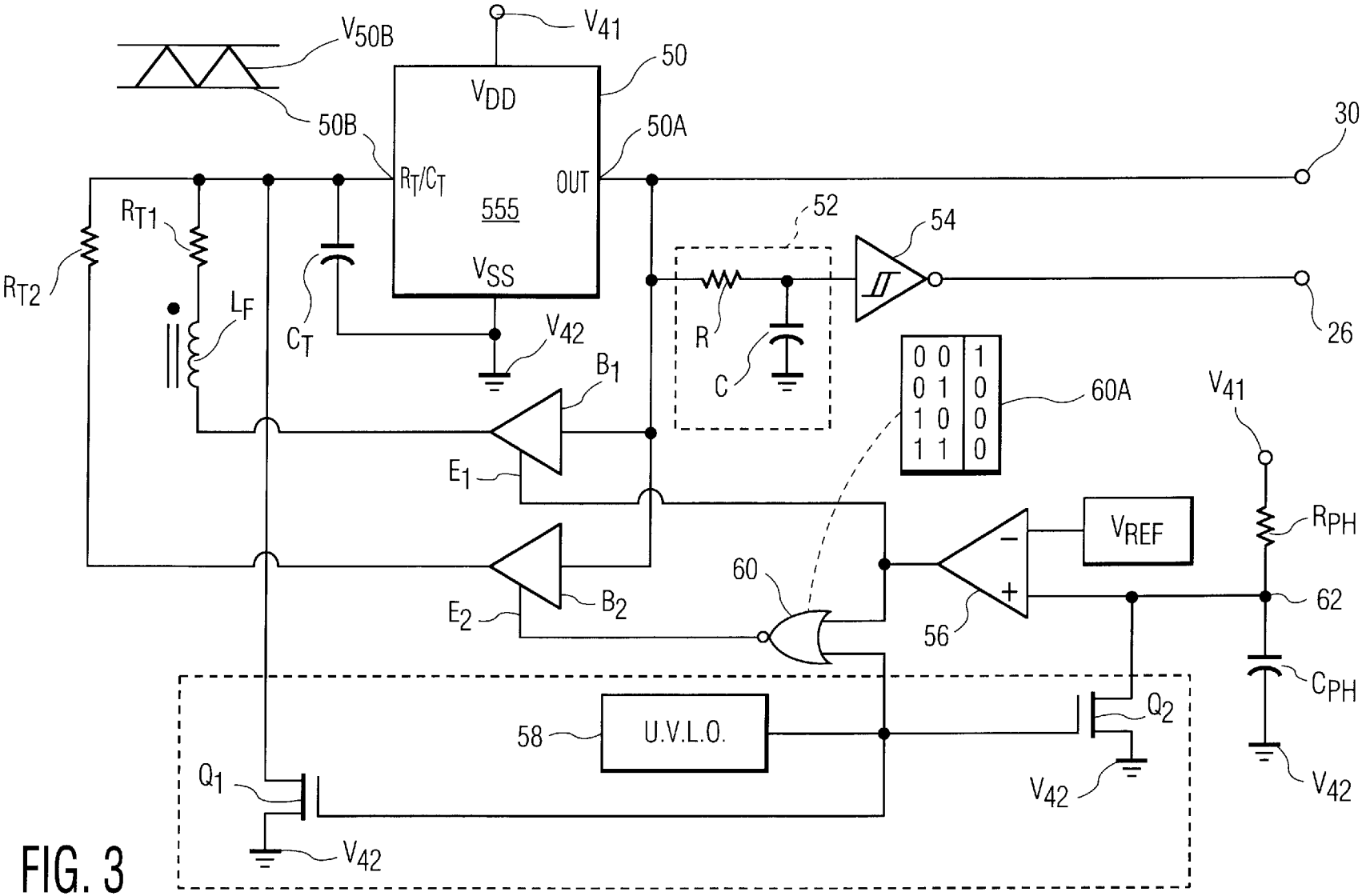
FIG. 3 is a schematic diagram, partially in block form, of an oscillator and associated circuitry for use in the circuit of FIG. 1.

FIG. 3 shows a preferred implementation of oscillator 32 and buffers 32A and 32B of FIG. 1, which may include a standard 555 IC timer 50. Timer 50 is powered, as shown, by the difference in voltage between voltage $V_{41}$, the voltage or potential at node 41 of FIG. 1, and voltage $V_{42}$, the voltage or potential at node 42. An output 50A timer 50 corresponds to output 30 of buffer 32B of FIG. 1. Output 26 of buffer 32A may be realized by delaying the signal on output 50A through an R-C circuit 52, and squaring the resulting signal by passing it through an inverting buffer 54, preferably with hysteresis. The output of buffer 54 is output 26.

A timing capacitor $C_T$ is connected between a timing input 50B of timer 50 and the lower-shown node at voltage $V_{42}$. Timing capacitor $C_T$ cooperates with either timing resistor $R_{T1}$ or $R_{T2}$ to cause voltage $V_{50B}$ at timing input 50B to alternately decrease and increase between upper and lower voltage thresholds, as indicated in FIG. 3. When voltage $V_{50B}$ reaches one of the thresholds, the output of timer 50 changes state. Voltage $V_{50B}$ increases or decreases generally according to an R-C time constant set by the combination of timing capacitor $C_T$ and one of timing resistors $R_{T1}$ or $R_{T2}$. When resistor $R_{T1}$ is coupled to timing input 50B, the excursion of voltage $V_{50B}$ is also influenced by the voltage induced on a feedback winding $L_F$ which is coupled to resonant inductor $L_R$ of FIG. 1, and poled with respect to that inductor as shown by the solid dots shown next to such items.

The selection of whether timing resistor $R_{T1}$ or $R_{T2}$ is to be coupled to timing input 50B may be determined with the use of tri-state buffers $B_1$ and $B_2$, which have enable inputs $E_1$ and $E_2$. The output of each tri-state buffer tracks its input (e.g., logic "1" or "0") when its enable input is at logic "1"; when its enable input is at logic "0", the output of the buffer is in its third, or high impedance state. For example, when enable input $E_2$ is at a logic "0" state, buffer $B_2$ provides a high impedance output, which decouples timing resistor $R_{T2}$ from timing input 50B. Control of the logic states of enable inputs $E_1$ and $E_2$ is preferably provided by logic circuitry including a preheat comparator 56 and an undervoltage lock-out (UVLO) circuit 58.

Figure 4A:
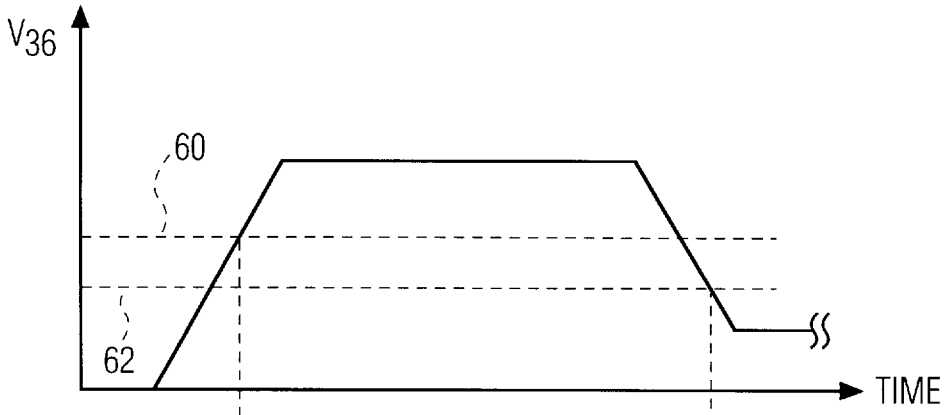
FIGS. 4A and 4B respectively show a voltage sensed by the undervoltage lock-out (UVLO) circuit of FIG. 3 and the logic level output of the UVLO circuit.
Figure 4B:
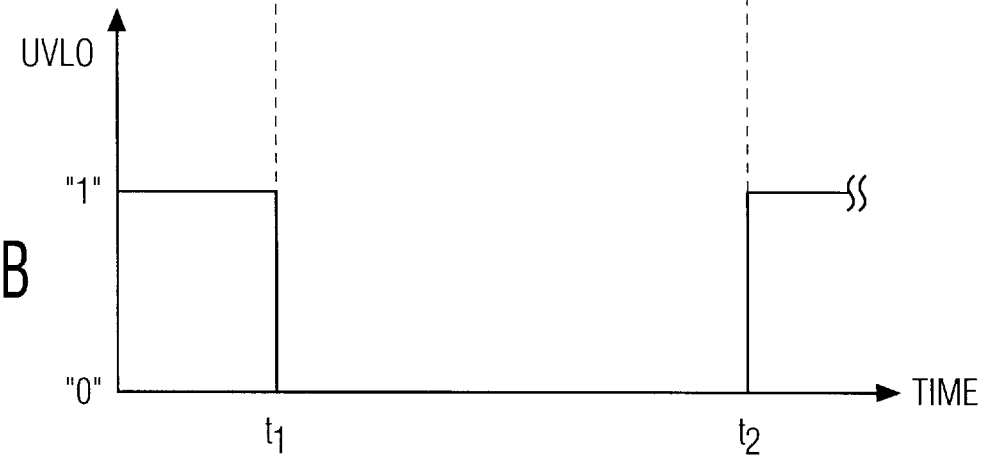

UVLO circuit 58 preferably senses voltage $V_{36}$ across capacitor 36 of FIG. 1, which may supply energy for various functions (e.g., to power timer 50). As shown in FIGS. 4A and 4B, when voltage $V_{36}$ rises upon initial bus energization to a threshold level 60, at time $t_1$, the logic-level output of UVLO circuit 58 changes from "1" to "0". When that voltage then decreases below another threshold level, 62, at time $t_2$, the output of UVLO circuit 58 changes back to logic level "1". Threshold level 62 preferably differs from, and is less than, logic level 60, which imparts a range of hysteresis to the UVLO circuit.

Upon initial bus energization, UVLO circuit 58 produces an output of logic "1" (see FIGS. 4A and 4B), which is applied to the gates of MOSFET switches $Q_1$ and $Q_2$, turning those switches on. As a result, switch $Q_1$ disables timer 50 by holding timing input 50B to voltage $V_{42}$, and switch $Q_2$ keeps the positive input of preheat comparator 56 below a reference voltage $V_{REF}$ so that the comparator output is maintained at logic "0". At this time, the "1" output from the UVLO circuit is applied at the lower-shown input to a logic NOR gate 60. As a truth table 60A for NOR gate 60 shows, a logic "1" in either of the input columns (i.e., first two columns) results in a logic "0" output (third column). When the UVLO circuit senses adequate voltage on capacitor 36 (FIG. 1), its output goes to "0" and the output of NOR gate 60 goes to "1" according to the first row of truth table 60A, while switches $Q_1$ and $Q_2$ become disabled.

With NOR gate 60 providing a logic "1" to enable input $E_2$, timing resistor $R_{T2}$ now becomes coupled between output 50A and input 50B of timer 50. The timer then starts to oscillate with a frequency determined by the R-C time constant of that resistor and capacitor $C_T$. Such time constant is selected to prevent ignition of lamp 18 (FIG. 1) while its cathodes 18A and 18B become resistively heated to a desired operating temperature. The duration of the cathode preheat period may be set by the serial combination of a preheat resistor $R_{PH}$ and a preheat capacitor $C_{PH}$ connected between voltage $V_{41}$ and $V_{42}$, with their intermediate node 62 connected to the positive input of preheat comparator 56. After switch $Q_2$ is disabled, preheat capacitor $C_{PH}$ starts to charge towards reference voltage $V_{REF}$, and upon surpassing that reference voltage, causes, preheat comparator 56 to change its output to a logic "1". In turn, buffer $B_1$ becomes enabled, and, as shown by the first two columns of truth table 60A, the output of NOR gate 60 switches to logic "0", disabling buffer $B_2$. Then, the oscillation frequency of timer 50 becomes governed by timing resistor $R_{T1}$ in conjunction with the voltage developed across feedback winding $L_F$.

Feedback winding $L_F$ allows the frequency of operation of the resonant load circuit (FIG. 1) to migrate towards its natural resonant frequency. Before the lamp has started, when its resistance is quite high, operation at the natural resonant frequency results in a large voltage being impressed across the lamp, which is desirable for reliably starting the lamp. After the lamp has started, when its resistance falls to a much lower level, the natural resonant frequency of the load circuit typically migrates to a different operating frequency at a lower lamp voltage.

In particular, feedback winding $L_F$ is preferably coupled to resonant inductor $L_R$ in such manner as to increase frequency of timer (or oscillator) 50 when current flowing into the resonant inductor from node 16 lags the voltage between common node 16 and reference conductor 14, and to decrease its frequency when such current leads such voltage.

Exemplary values for various aspects of FIG. 3 when using the above-mentioned component values for the circuit of FIG. 1, are as follows:

| | |
|---|---|
| Timing resistor $R_{T1}$ | 7.5K ohms |
| Timing resistor $R_{T2}$ | 7.5K ohms |
| Resonant winding $L_R$ | 800 microhenries |
| Feedback winding $L_F$ | 80 picohenries |
| Feedback winding $L_F$ turns | 1 |
| Resonant inductor $L_R$ turns | 100 |
| Turns ratio between $L_R$ and $L_F$ | 100-to-1 |
| Timing capacitor $C_T$ | 1.0 nanofarads |
| Cathode preheat period | 1.0 second |

Additionally, tri-state buffers $B_1$ and $B_2$ may comprise part no. CD4503B, sold by National Semiconductor of Santa Clara, Calif.

The foregoing describes a gas discharge ballast circuit of the type including a pair of switches of a d.c.-to-a.c. converter. The ballast circuit achieves good control capability as well as the ability to work at high speeds. It includes a function for synchronizing the frequency of lamp current to desired starting and operating levels, while also providing a cathode preheat function.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit for a gas discharge lamp, comprising:

(a) a resonant load circuit incorporating the gas discharge lamp and including a resonant inductance and a resonant capacitance;

(b) a d.c.-to-a.c. converter circuit coupled to said resonant load circuit for inducing an a.c. current in said resonant load circuit, said converter circuit comprising:

(i) first and second converter switches serially connected in the foregoing order between a bus conductor at a d.c. voltage and a reference conductor, and being connected together at a common node through which said a.c. load current flows;

(ii) said first and second converter switches each comprising a control node and a reference node, the voltage between such nodes determining the conduction state of the associated switch;

(iii) the respective control nodes of said first and second converter switches being interconnected; and (iv) the respective reference nodes of said first and second converter switches being connected together at said common node;

(c) a bridge network connected between first and second nodes and having:

(i) first and second input nodes on which respective first and second input signals are applied; and (ii) first and second output nodes respectively connected to said common and control nodes so as to control the switching state of said converter switches;

(d) an oscillator for providing said first and second input signals; said oscillator having a timing input and an output; and (e) a first resistor and a serially connected feedback winding coupled to said timing input; said feedback winding being coupled to said resonant inductance so as to increase frequency of said oscillator when current in said resonant inductance from said common node lags the voltage between said common node and said reference conductor, and to decrease said frequency when said current leads said voltage.

2. The ballast circuit of claim 1, further comprising:

(a) a second resistor coupled to said timing input so as to set the frequency of said oscillator at a level that generates an appropriately large starting voltage across said lamp; and (b) control circuitry for decoupling said first resistor from said timing input while coupling said second resistor to said timing input during a predetermined preheat period, in which cathodes of said lamp become heated.

3. The ballast circuit of claim 2, further comprising undervoltage circuitry for disabling current flow through said first and second resistors when an operating voltage of said ballast circuit has not yet risen to a predetermined level, and when said operating voltage falls below a predetermined level.

4. The ballast circuit of claim 1, wherein the frequency of said oscillator is determined by the time for the voltage at its timing input to change between first and second levels.

5. The ballast circuit of claim 4, wherein said output of said oscillator is coupled to said timing input through said first resistor.

6. A ballast circuit for a gas discharge lamp, comprising:

(a) a resonant load circuit incorporating the gas discharge lamp and including a resonant inductance and a resonant capacitance;

(b) a d.c.-to-a.c. converter circuit coupled to said resonant load circuit for inducing an a.c. current in said resonant load circuit, said converter circuit comprising:

(i) first and second converter switches serially connected in the foregoing order between a bus conductor at a d.c. voltage and a reference conductor, and being connected together at a common node through which said a.c. load current flows;

(ii) said first and second converter switches each comprising a control node and a reference node, the voltage between such nodes determining the conduction state of the associated switch;

(iii) the respective control nodes of said first and second converter switches being interconnected; and (iv) the respective reference nodes of said first and second converter switches being connected together at said common node;

(c) a voltage-limited energy source connected between first and second nodes;

(d) said first node being connected to said bus conductor through a bootstrap capacitor, and said second node being connected to said reference conductor through a bootstrap capacitor; and (e) a bridge network connected between said first and second nodes and having:

(i) first and second input nodes on which respective first and second input signals are applied; and (ii) first and second output nodes respectively connected to said common and control nodes so as to control the switching state of said converter switches;

(f) an oscillator for providing said first and second input signals; said oscillator having a timing input and an output;

(g) said bridge network being arranged to cause repetitive cycling through at least the following states of said first and second converter switches respectively being:

(i) on and off;

(ii) turned off and already off, and residual energy of said resonant inductance causing a shift in energy from one of said bootstrap capacitors to the other of said bootstrap capacitors via said energy source, thereby replenishing said source with energy;

(iii) off and on;

(iv) already off and turned off, and residual energy of said resonant inductance causing a shift in energy from said other of said bootstrap capacitors to said one of said bootstrap capacitors via said energy source, thereby replenishing said source with energy; and (h) a first resistor and a serially connected feedback winding coupled to said timing input; said feedback winding being coupled to said resonant inductance so as to increase frequency of said oscillator when current in said resonant inductance from said common node lags the voltage between said common node and said reference conductor, and to decrease said frequency when said current leads said voltage.

7. The ballast circuit of claim 6, further comprising:

(a) a second resistor coupled to said timing input so as to set the frequency of said oscillator at a level that generates an appropriately large starting voltage across said lamp; and (b) control circuitry for decoupling said first resistor from said timing input while coupling said second resistor to said timing input during a predetermined preheat period, in which cathodes of said lamp become heated.

8. The ballast circuit of claim 7, further comprising undervoltage circuitry for disabling current flow through said first and second resistors when an operating voltage of said ballast circuit has not yet risen to a predetermined level, and when said operating voltage falls below a predetermined level.

9. The ballast circuit of claim 6, wherein the frequency of said oscillator is determined by the time for the voltage at its timing input to change between first and second levels.

10. The ballast circuit of claim 9, wherein said output of said oscillator is coupled to said timing input through said first resistor.

11. The ballast circuit of claim 6, wherein said oscillator is arranged to cause repetitive cycling between first input signal-second input signal pairs of at least high-low, high-high, low-high, and low-low states.

12. The ballast circuit of claim 6, wherein said bridge circuit comprises:

(a) a first pair of gate control switches connected between said first and second nodes, having complementary conduction modes which change in response to a first input signal applied to commonly connected control nodes of said switches, and being connected together serially at said first output node; and (b) a second pair of gate control switches connected between said first and second nodes, having complementary conduction modes which change in response to a second input signal applied to commonly connected control nodes of said switches, and being connected together serially at said second output node.

13. The ballast circuit of claim 12, wherein said first and second pairs of gate control switches comprise drain-connected CMOS transistors, with like-conduction mode transistors being connected to said first node.

14. The ballast circuit of claim 6, further including means to power said oscillator and to supply power to control said bridge network from said energy source.

15. The ballast circuit of claim 14, wherein said first and second pairs of control switches and said oscillator are contained in an integrated circuit.

16. The ballast circuit of claim 15, wherein said energy source contains a Zener diode for voltage-limiting purposes, said Zener diode also being contained in said integrated circuit.

17. The ballast circuit of claim 15, wherein said first and second converter switches are also contained in said integrated circuit.

* * * * *